US008376659B2

(12) United States Patent
Baugh

(10) Patent No.: US 8,376,659 B2
(45) Date of Patent: Feb. 19, 2013

(54) ARCTIC PLATFORM METHOD

(76) Inventor: Benton F. Baugh, Houston, TX (US)

( * ) Notice: Subject to any disclaimer, the term of this patent is extended or adjusted under 35 U.S.C. 154(b) by 2085 days.

(21) Appl. No.: 10/899,361

(22) Filed: Jul. 26, 2004

(65) Prior Publication Data

US 2006/0016607 A1 Jan. 26, 2006

(51) Int. Cl.
*E21B 1/00* (2006.01)
*E21B 23/00* (2006.01)

(52) U.S. Cl. ..... 405/244; 405/217; 405/239; 166/901

(58) Field of Classification Search ..... 405/217, 405/234, 239, 244; 166/901
See application file for complete search history.

(56) References Cited

U.S. PATENT DOCUMENTS 3,598,184 A * 8/1971 Schuh ..... 166/302
3,703,812 A * 11/1972 Newton ..... 405/244
3,706,204 A * 12/1972 Long ..... 405/130
3,818,992 A * 6/1974 Perkins ..... 166/305.1
3,830,303 A * 8/1974 Perkins ..... 166/297
3,921,410 A * 11/1975 Philo ..... 405/232
3,995,695 A * 12/1976 Perkins et al. ..... 166/302
4,067,198 A * 1/1978 Long ..... 405/130
4,121,427 A * 10/1978 Tuttle ..... 405/130
4,784,528 A * 11/1988 Spalding et al. ..... 405/226
5,050,356 A * 9/1991 Johnson et al. ..... 52/295
5,320,452 A * 6/1994 Kunito ..... 405/233
6,745,852 B2 * 6/2004 Kadaster et al. ..... 175/5
2003/0209363 A1 11/2003 Kadaster et al.

OTHER PUBLICATIONS

Pat. App., Baugh, Watson, Kadaster & Millheim, filed Aug. 3, 2004.

* cited by examiner

*Primary Examiner* — Tara M. Pinnock

(57) ABSTRACT

A method of supporting a double hull platform section above the surface of the earth for the exploration of oil, gas, or hydrate reserves comprising lowering a platform to a distance above the surface of the earth, engaging a first set of supports with the surface of the earth, drilling holes in the earth, inserting a second set of supports in the drilled holes, adding a slurry in to the drilled holes, allowing the slurry to freeze to support the platform, and disengaging said first set of supports from the earth.

17 Claims, 14 Drawing Sheets

ARCTIC PLATFORM METHOD

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The present invention relates generally to the field of oil and gas drilling and more particularly to a method of and system for building structures and drilling oil and gas wells in arctic, inaccessible or environmentally sensitive locations without disturbing the ground surface as is done in conventional land drilling operations.

DESCRIPTION OF THE PRIOR ART

Historically, the drilling and development of land oil and gas wells requires a designated area on which to locate the drilling rig and all of the support equipment. Usually, drilling locations are reached by some type of road or other access. In rare situations, access is via airlift, either by helicopter, fixed wing aircraft, or both.

Many areas of the world that have potential for oil and gas exploration and development are constrained by special circumstances that make transportation of drilling equipment to a drilling site difficult or impossible. For example, oil and gas may be found in terrain with near-surface water accumulations, such as swamps, tidal flats, jungles, stranded lakes, tundra, muskegs, and permafrost regions. In the case of swamps, muskegs and tidal flats, the ground is generally too soft to support trucks and other heavy equipment. In the case of tundra and permafrost regions, heavy equipment can be supported only during the winter months.

Additionally, certain regions where oil and gas may be found are environmentally sensitive, such that surface access by transporting vehicles can damage the terrain or affect wildlife breeding areas or migration paths. The environmental problems are particularly acute in arctic tundra and permafrost regions. In such areas, road construction is either prohibited or limited to temporary seasonal access.

There are substantial oil and gas reserves in the far northern reaches of Canada and Alaska. However, drilling in such regions presents substantial engineering and environmental challenges. The current art of drilling onshore in arctic tundra is enabled by the use of special purpose vehicles, such as Rolligons™, that can travel across ice roads built on frozen tundra.

Ice roads are built by spraying water chipped ice or snow on a frozen surface at very cold temperatures. Ice roads are typically 35 feet wide and 6 inches thick. At strategic locations, the ice roads are made wider to allow for staging and turn around capabilities.

Land drilling in arctic regions is currently performed on ice pads, which are typically 500 feet by 500 feet, which for the most part comprises 6-inch thick ice. Typically, the rig itself is built on a 6 to 12-inch thick ice pad. A reserve pit is typically constructed with over a two-foot thickness of ice plus an ice berm, which provides at least two feet of freeboard above the pit's contents. These reserve pits, which are also referred to as ice-bermed drilling waste storage cells, typically have a volume capacity of 45,000 cubic feet for an estimated 15,000 cubic feet of cuttings and fluid effluent. In addition to the ice roads and the pad, an arctic drilling location typically includes an airstrip, which is essentially an ice road.

The ice roads may be tens of miles to hundreds of miles in length, depending upon the proximity or remoteness of the existing infrastructure. The fresh water needed for the ice to construct the roads and pads is usually obtained from lakes and ponds that are typically numerous in such regions. The construction of an ice road may typically require 1,000,000 gallons of water per mile. Over the course of a winter season, as much as 200,000 gallons per mile may be required to maintain the ice road. Therefore, for a ten mile ice road, a total of 12,000,000 gallons of water would have to be picked up from nearby lakes and sprayed on the selected roadbed route. An airstrip may require up to 2,000,000 gallons and a single drill pad may require up to 1,700,000 gallons of water. For drilling operations on a typical 30-day well, the requirement would be approximately 20,000 gallons per day, for a total of 600,000 gallons for the well. A 75-man camp would require an additional 5,000 gallons per day or 150,000 gallons per month. Sometimes, there are two to four wells drilled from each pad, frequently with a geological sidetrack in each well.

In summary, for a winter program of 7 wells, requiring about 75 miles of road, with 7 drilling pads, an airstrip, a 75-man camp and drilling of 5 new wells, plus re-entry of two wells left incomplete, the fresh water requirements could be on the order of 150 million gallons.

Arctic land drilling operations such as this may be conducted only during the winter months. Typically, roadwork commences by the first half of January simultaneously with location building and rig mobilization. Due to the lack of ice roads, initial mobilizations are done with special purpose vehicles such as Rolligons™, approved for use on the tundra. Drilling operations typically commence the first week of February and last until the middle of April, at which time all equipment and waste pit contents must be removed before the ice pads and roads melt. However, in the Alaskan North Slope, the tundra is closed to all traffic from May 15 to July 1 due to nesting birds and Caribou calving. If the breakup is late, then prospects can be fully tested before demobilizing the rig. Otherwise all [1]the infrastructure has to be rebuilt the following season.

From the foregoing, it may be seen that there are several drawbacks associated with current arctic drilling technology. Huge volumes of water are pumped out of ponds and lakes and then allowed to thaw out and become surface run off again. The ice of the roads can become contaminated with lube oil and grease, antifreeze, and rubber products. In addition to environmental impact, the economic costs of drilling in arctic regions is very high. Operations may be conducted only during the coldest parts of the year, which is typically less than 4 or 5 months. Actual drilling and testing may be conducted in a window of only two to four months or less. Therefore, development can occur during less than half the year.

The need to drill in extreme environmental conditions such as exist in the artic tundra provides a number of requirements which do not exist in normal temperate areas where drilling operations are more common. Some of these conditions are:

1. The need for absolute pollution prevention,
2. Modularization of components so they can be easily trucked, both locally between well locations and from manufacturing facilities in distant locations,
3. Extreme compactness of the drilling equipment as often it must be stacked on the platform only and not spread out at ground level,
4. Everything must be off the ground on low footprint pilings so that the tundra is not damaged in times when the tundra is not frozen hard,
5. Monitoring of explosive or poisonous gases,
6. Compensation for the potential of the support pilings to creep down into icy formations under heavy loads,
7. Means for the easy removal of all support posts when the well site is abandoned, and
8. Means to leave the platform structure during spring thaw and caribou calving seasons.

A first arctic platform has been fabricated and addresses many of these concerns. It provides several interlocking bucket sections with independent deck sections which land over pre-installed posts. Holes for the posts are drilled in place, the posts are installed, and then a slurry of sand and water are poured in to freeze. This equipment has been successfully used, however, it provides the following disadvantages:

1. The support posts must be preinstalled to very tight tolerances to allow the landing of the bucket sections,
2. As they are interlocked, they must be assembled and disassembled in an exact sequence.
3. During the drilling of the holes, if a large rock is encountered which would deflect the drill bit, the location of the platform must be moved, causing the drilling to be started all over. There would be no guarantee that a similar rock or other impediment would not be found at t the new location also, requiring another move.
4. As the holes are drilled and the support posts are frozen in place by measurements, complicated alignment means are required to engage the final position of the support posts with the holes in the bucket sections.
5. The size of alignment guides allowed by the bucket sections tends to be limited to a relative small size in comparison to what would be required for helicopter operations.

SUMMARY OF THE INVENTION

The object of this invention is to provide a support system for a group of platform sections which can be landed on the arctic tundra and then have the support posts installed.

A second object of the present invention is to provide a support running tools which provide sufficient guidance to allow handling and landing by a helicopter.

A third object of this invention is to allow for any section to be removed from an assembled platform in any sequence.

Another object of this invention is to provide for installing the support posts or the platform sections first.

Another object of this invention is to provide double hull design to allow for the safe storage of liquids Another object of this invention is to provide for automatically setting the feet to the tundra for temporary support of the platform sections when the platform section reaches a predetermined height above the tundra or other landing surface.

Another object of this invention is to provide a stable base for drilling such that when a rock or other difficult to drill impediment is encountered during drilling, it can be drilled, hammered, or blasted thru.

Another object of this invention is to provide a construction where the deck provides for strength capacity as well as the bucket section.

Another object of this invention is to provide a second set of supports posts which can be supported by the bucket section during freezing in, and then can remain in place when the platform is removed.

Another object of this invention is to provide the ability to come back and land and support the bucket sections on the remaining legs.

Another object of this invention is to break ice free before dropping the first leg.

Another object of this invention is to provide a cylinder assembly which will use a vacuum to hole the first leg in position, starting pressured movement to break ice free, continuing pressured movement to drop the first leg, and continuing pressured movement to load the first leg.

Another object of this invention is to provide a path down the second leg to deliver the slurry to the hole outside the second leg.

Another object of this invention is to provide a specific movement of the landing leg to break any ice formations prior to dropping the landing leg to the tundra.

Another object of this invention is to provide a double hull platform for environmental protection.

BRIEF DESCRIPTION OF THE PREFERRED EMBODIMENT

Figure 1:
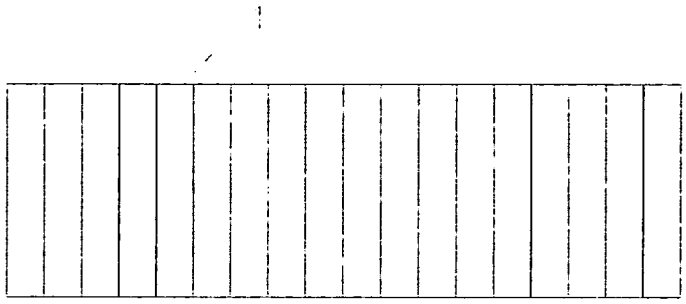
FIG. 1 is a top view of a platform of this invention.

Referring now to FIG. 1, the platform 1 is shown in a top view with 18 platform sections 2 in a single row for a relatively long and narrow working area. Various arrangements of the platforms can yield elongated or square work areas. The likely sizing of each of the platform sections is 12' wide×70' long, yielding a surface area of 70'×216'. A double wide platform of this nature would be 140'×216'.

Figure 2A:
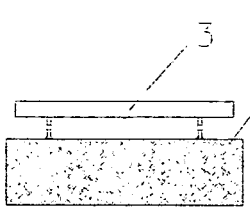
FIG. 2 is a side and end view of the platform which has been landed on the first set of posts.
Figure 2B:
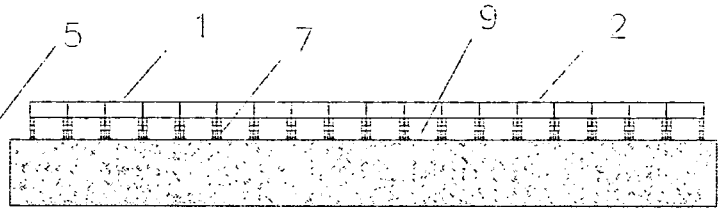

Referring now to FIG. 2, the platform is shown in FIG. 2A from the short side and in FIG. 2B on the long side. A sonar unit 3 is below the first of the platform sections to be landed and when it reaches a predetermined distance form the tundra 5, i.e. 7', it sends a signal for the landing posts or supports 7 to be released to the surface 9 of the tundra 5.

Figure 3A:
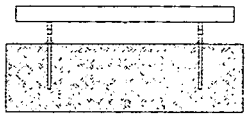
FIG. 3 is a side and end view of the platform holes drilled below the first set of posts and with the second set of posts frozen in place.
Figure 3B:
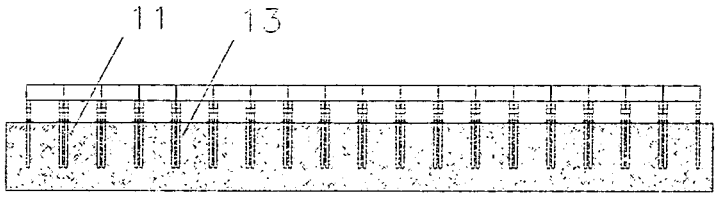

Referring now to FIG. 3, holes 11 have been drilled thru the landing posts 7 and Into the tundra 5. Support posts or supports 13 are lowered thru the platform section 2, the landing post 7 and into the hole 11. A mixture of sand and water called a slurry is poured into the hole around the support post and allowed to freeze. The frozen slurry will provide the support for the platform.

Figure 4A:
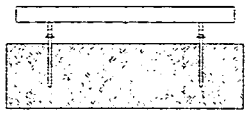
FIG. 4 is a side and end view of the platform with the first set of posts elevated above the tundra.
Figure 4B:
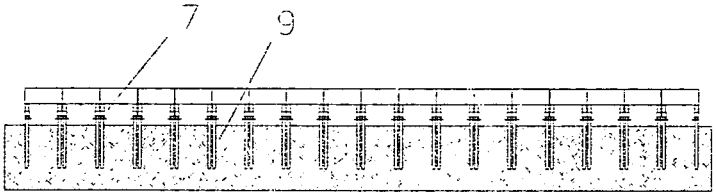

Referring now to FIG. 4, the landing posts which landed on the surface 9 of the tundra 5 are lifted off the tundra to protect the tundra from damage.

Figures 5A, 5B:
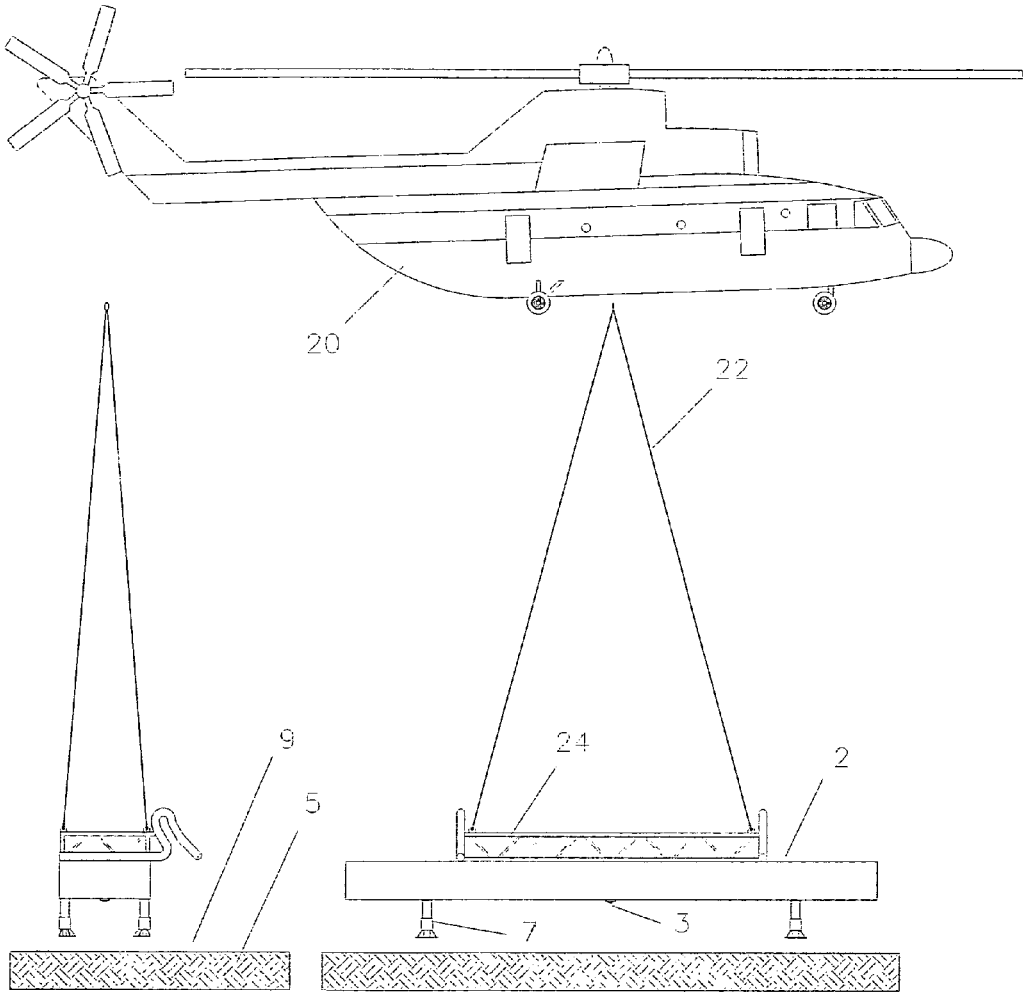
FIG. 5 is a side and end view of the first platform section being lowered by a sling from a helicopter.

Referring now to FIG. 5, a helicopter 20 is shown with a sling 22 depending downwardly to a handling frame 24, which is attached to a platform section 2. The platform is shown with a sonar unit 3 on the lower side which will send a signal to release the landing posts 7 when the platform section 2 reaches a specified distance above the surface 9 of the tundra 5.

Figure 6A:
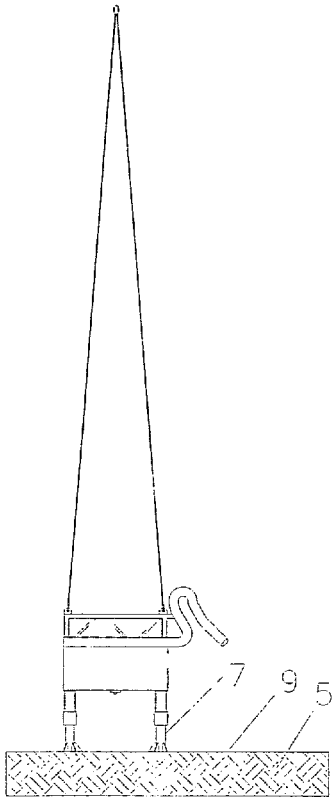
FIG. 6 is a side and end view illustrating that when a predetermined elevation was reached, the first set of posts dropped to the ground to support the platform section.
Figure 6B:
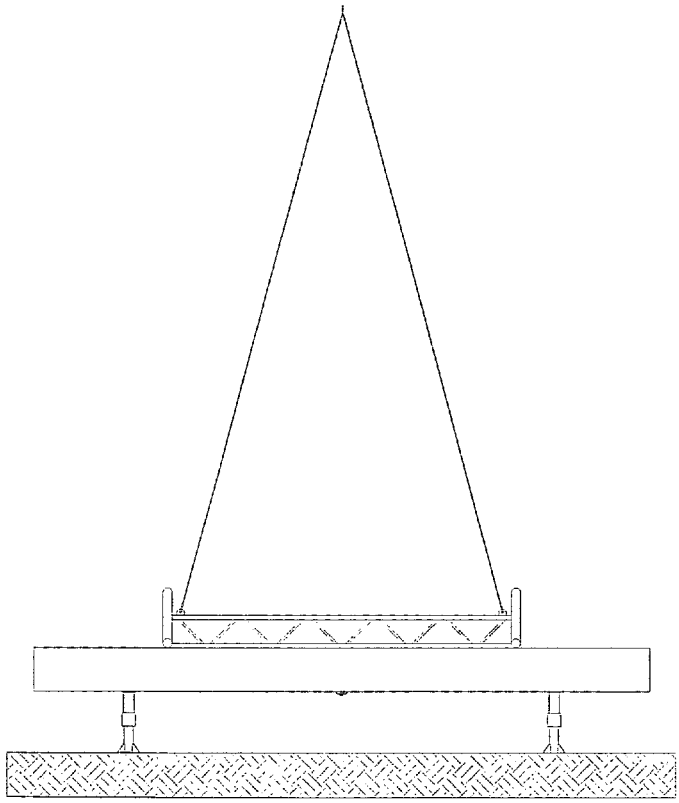

Referring now to FIG. 6, the landing posts 7 are shown dropped to the surface 9 of the tundra 5.

Figure 7A:
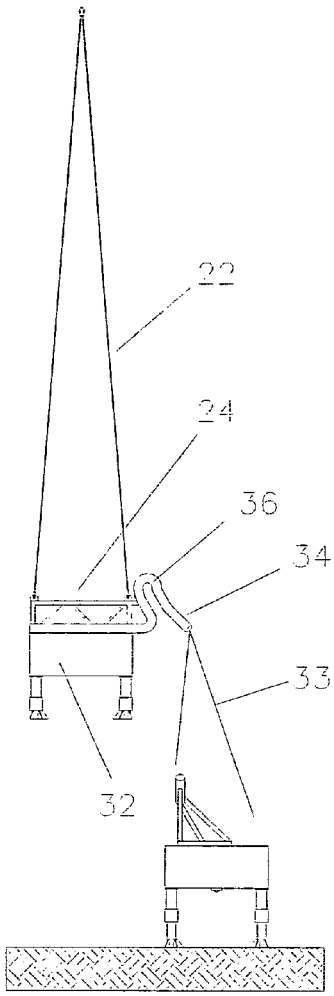
FIG. 7 is a side and end view illustrating that the handling frame was removed from the first platform section and is bring a second platform section. Receiving guides have been added to the first platform section.
Figure 7B:
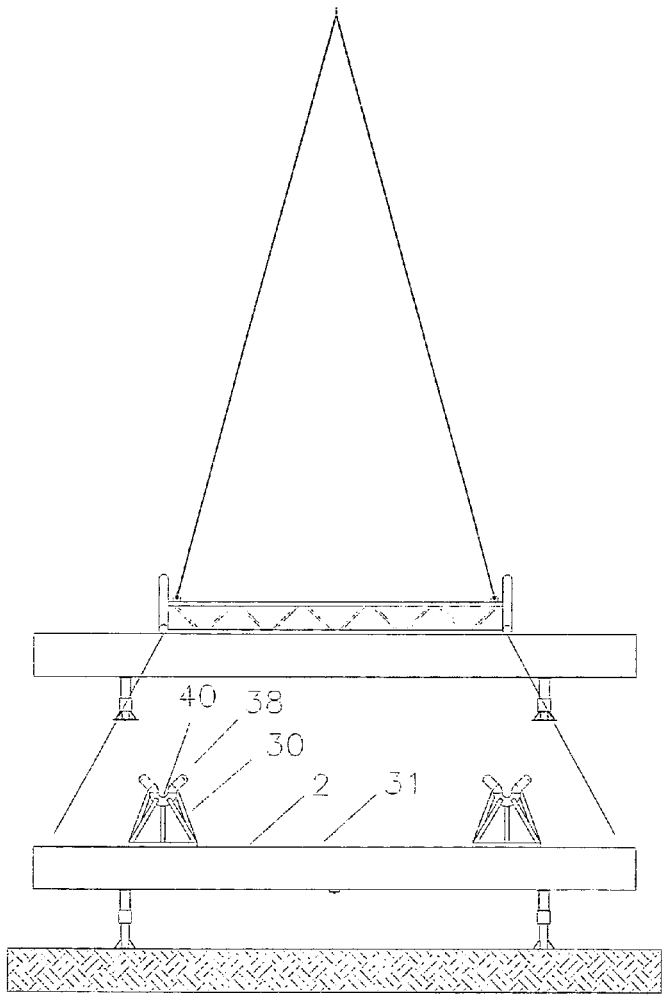

Referring now to FIG. 7, receiving guides 30 have been attached to the deck 31 of platform section 2. A second platform section 32 is being lowered by handling frame 24 with slings 22. Ropes 33 can be used in assisting the positioning of the second platform section 32 as it approaches the first platform section 2. The handling frame 24 has downwardly opening profile 34 with a crotch portion 36 near the top. The receiving guide 30 has an upwardly facing profile 38 with a crotch portion 40 near the bottom.

Figure 8A:
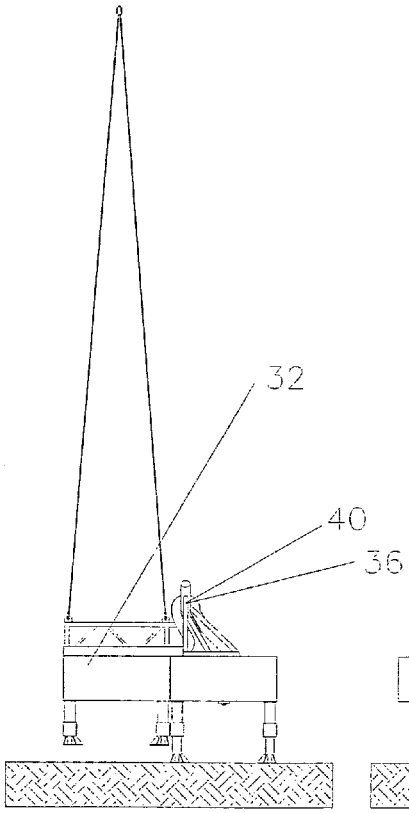
FIG. 8 is a side and end view showing that the second platform section has been guided into a position at the same elevation as the first platform section.
Figure 8B:
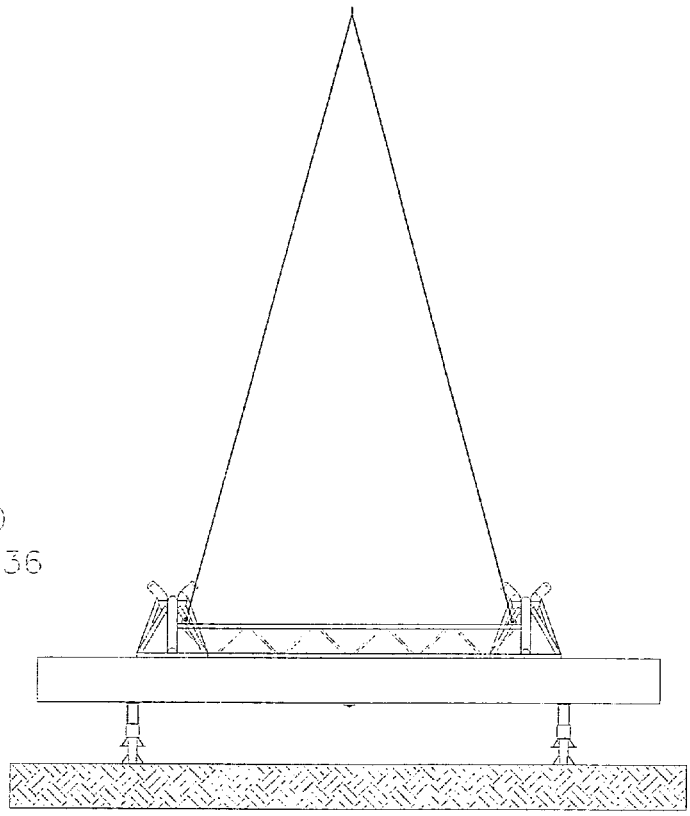

Referring now to FIG. 8, platform section 32 is lowered until the downwardly facing crotch 36 contacts the upwardly facing crotch 40. At this time the second platform section 32 is at the proper elevation.

Figure 9A:
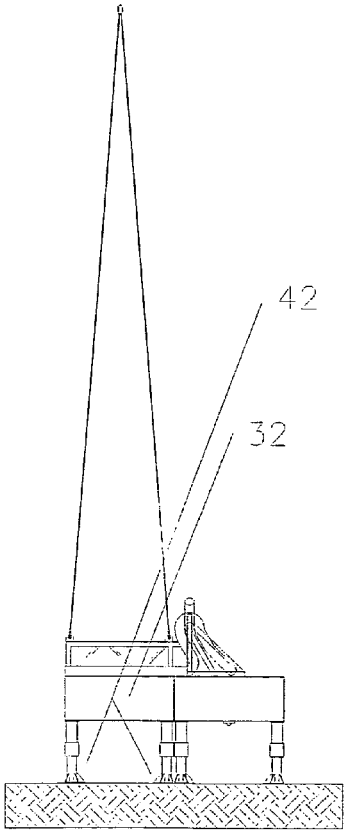
FIG. 9 is a side and end view illustrating that the first posts of the second platform section have been dropped to the tundra.
Figure 9B:
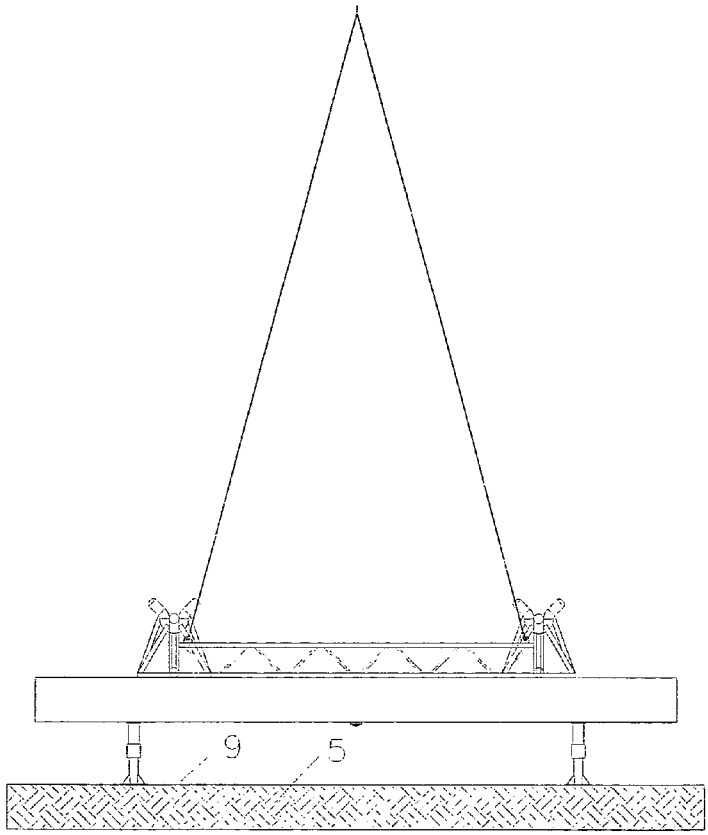

Referring now to FIG. 9, shows that the landing legs 42 of second platform 32 have been dropped to the surface 9 of the tundra 5.

Figure 10A:
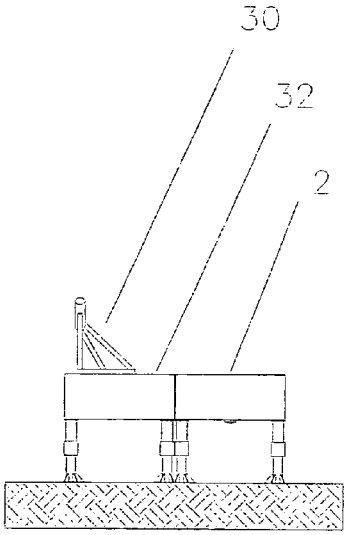
FIG. 10 is a side and end view showing that the helicopter has taken the handling frame from the second platform section is going after a third platform section. The receiving guides have been moved to the second platform section.
Figure 10B:
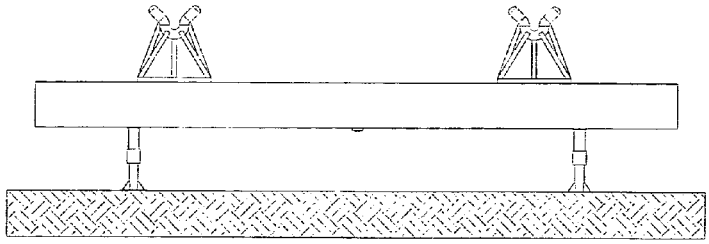

Referring now to FIG. 10, the handling frame 24 has been released from the second platform section 32 to go back by helicopter to get the third platform section. Receiving guide 30 has been moved forward the first platform section 2 to the second platform section 32, and is waiting on the arrival of the third platform section. This procedure will continue until all platform sections are landed.

Figure 11:
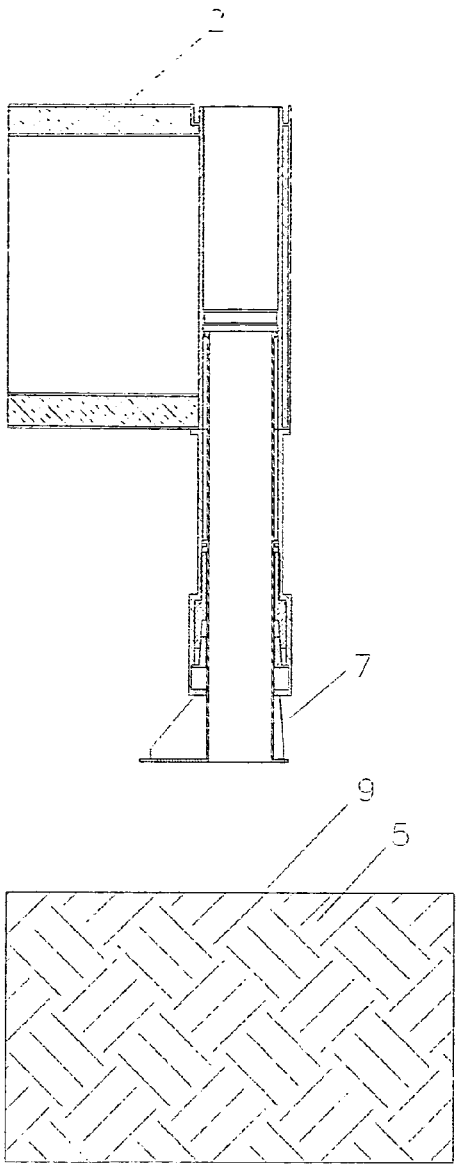
FIG. 11 is a half section thru the corner of a platform section showing that the platform section is lowered to an adequate elevation for dropping the leg.

Referring now to FIG. 11, a half section of a portion of platform section 2 is shown being lowered to a predetermined distance above the surface 9 of the tundra 5, and with landing post 7 depending below.

Figure 12:
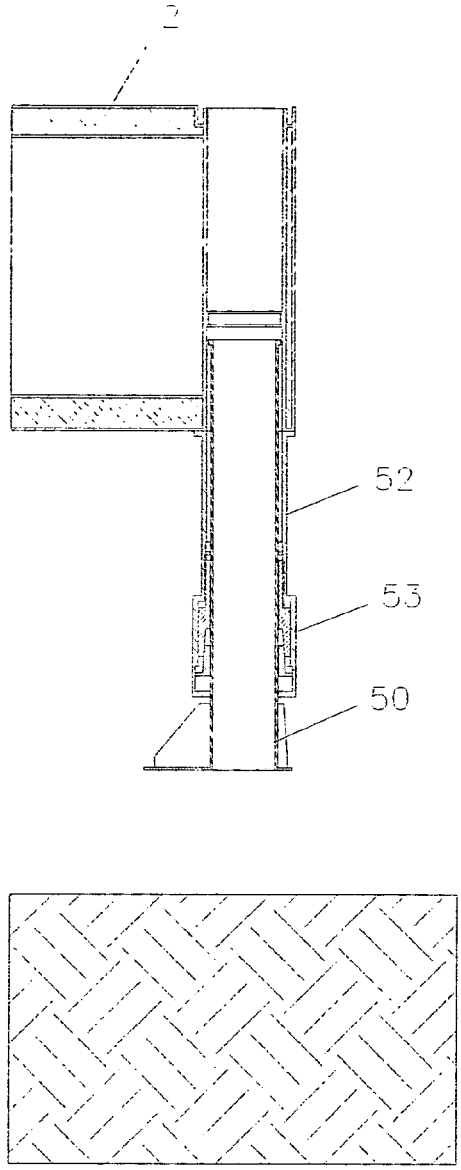
FIG. 12 is a half section thru the corner of a platform section showing that the piston has started the downward travel to break any ice free in the post and drop the central pipe section.

Referring now to FIG. 12, it shows a half section of a portion of platform section 2 with the inner sleeve 50 of landing post moved down slightly relative to the outer sleevel 52. This motion is done under power from a hydraulic supply (not shown) to hydraulic connector 53 to break any ice which may have formed between the inner sleeve 50 and the outer sleeve 52. This will be clarified later.

Figure 13:
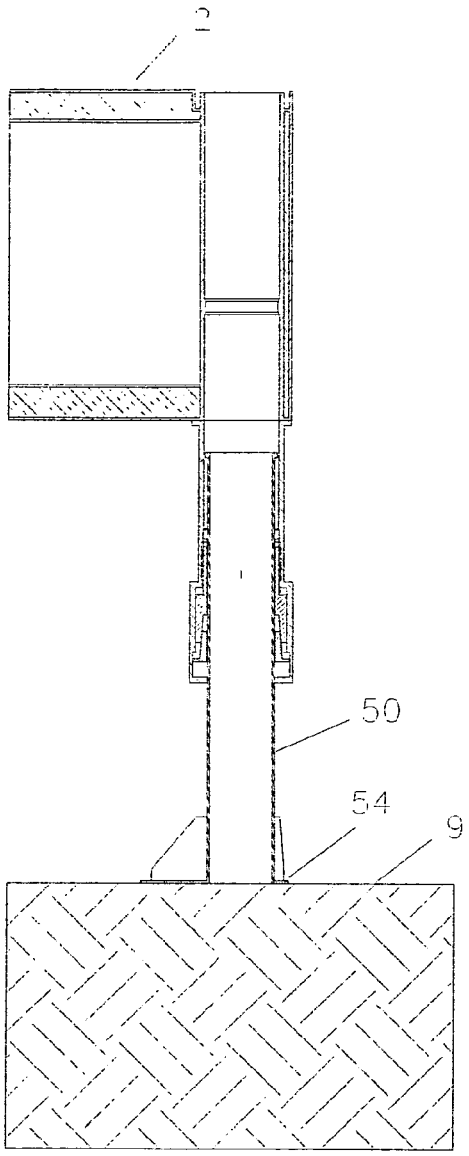
FIG. 13 is a half section thru the corner of a platform section showing that the central portion has been dropped to the tundra.

Referring now to FIG. 13, a half section of a portion of platform section 2 is shown with the inner sleeve 50 and its foot 54 having been dropped to the tundra surface 9.

Figure 14:
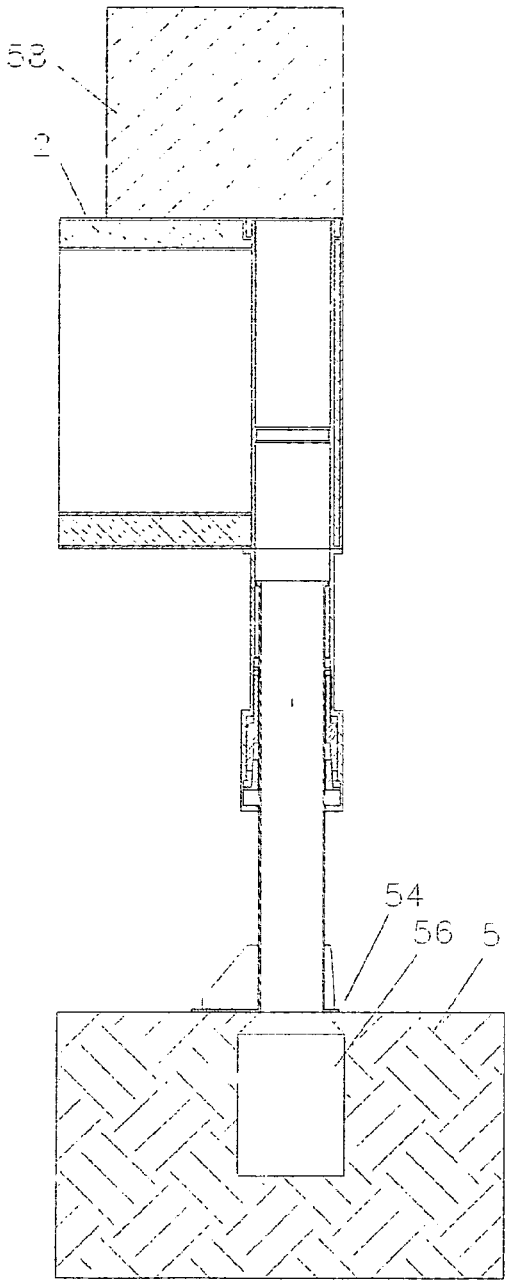
FIG. 14 is a half section thru the corner of a platform section showing that the hole has been drilled below the lower section.

Referring now to FIG. 14, a half section of a portion of platform section 2 is shown with a hole 56 drilled in the tundra 5 below the foot 54. Drilling unit 58 illustrates conventional equipment which might be set on the deck for this operation.

Figure 15:
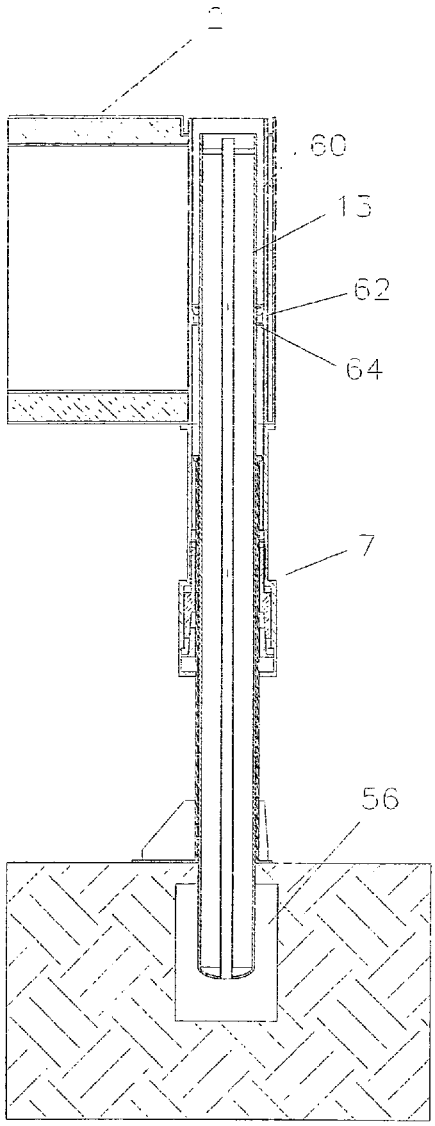
FIG. 15 is a half section thru the corner of a platform section showing the second post dropped into place against a shoulder in the platform section.

Referring now to FIG. 15, a half section of a portion of platform section 2 is shown with support post 13 inserted into sleeve 60 of platform section 2, extending downwardly thru the landing post 7 and into the hole 56. Threaded shoulder 62 on support post 13 engages upward facing shoulder 64 within the sleeve 60.

Figure 16:
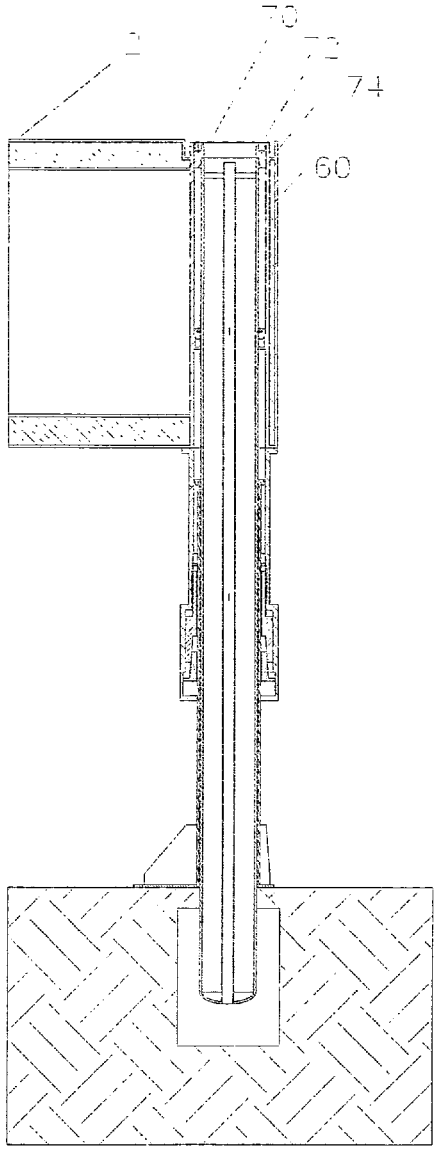
FIG. 16 is a half section thru the corner of a platform section showing that the top nut is added to the top of the second post.

Referring now to FIG. 16, a half section of a portion of platform section 2 is shown with nut 70 engaging external thread 72 in the internal diameter of sleeve 60 with a external thread 74 on the outside diameter of the nut.

Figure 17:
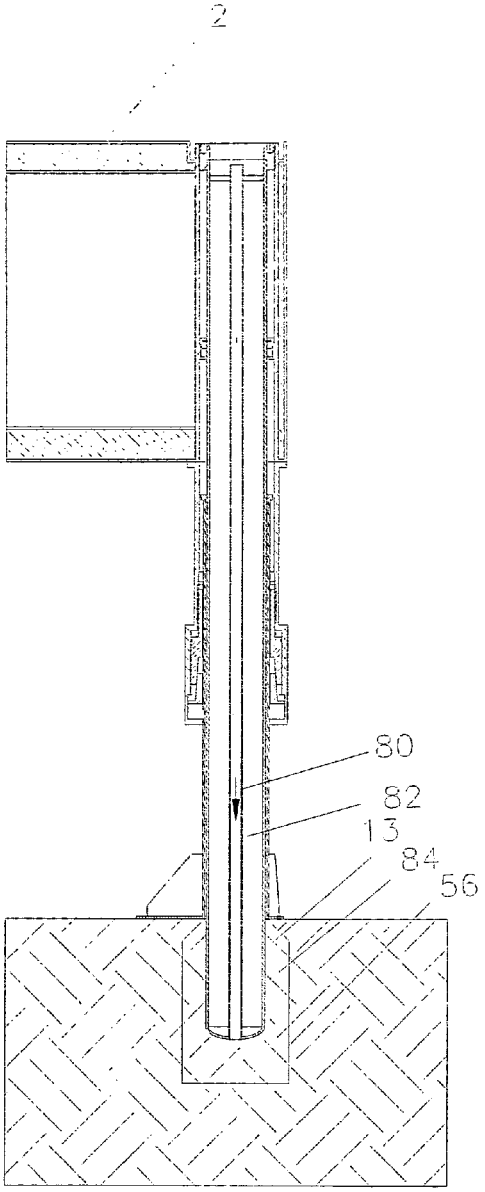
FIG. 17 is a half section thru the corner of a platform section showing the slurry has been added to the hole to freeze the post in place.

Referring now to FIG. 17, a half section of a portion of platform section 2 is shown with a slurry 80 of sand and water being pumped down central pipe 82 to fill up the area 84 between the support post 13 and the hole 56. The slurry 80 of sand and water will provide the foundational support for the support post 13.

Figure 18:
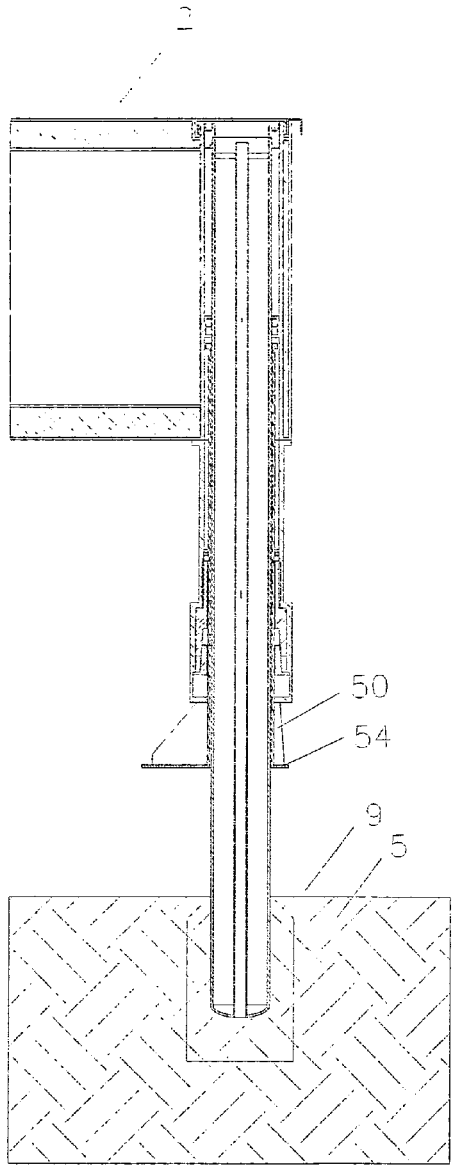
FIG. 18 is a half section thru the corner of a platform section showing the first post has been lifted from the tundra.

Referring now to FIG. 18, a half section of a portion of platform section 2 is shown with the inner sleeve 50 and foot 54 being raised off the surface 9 of the tundra 5

Figure 19:
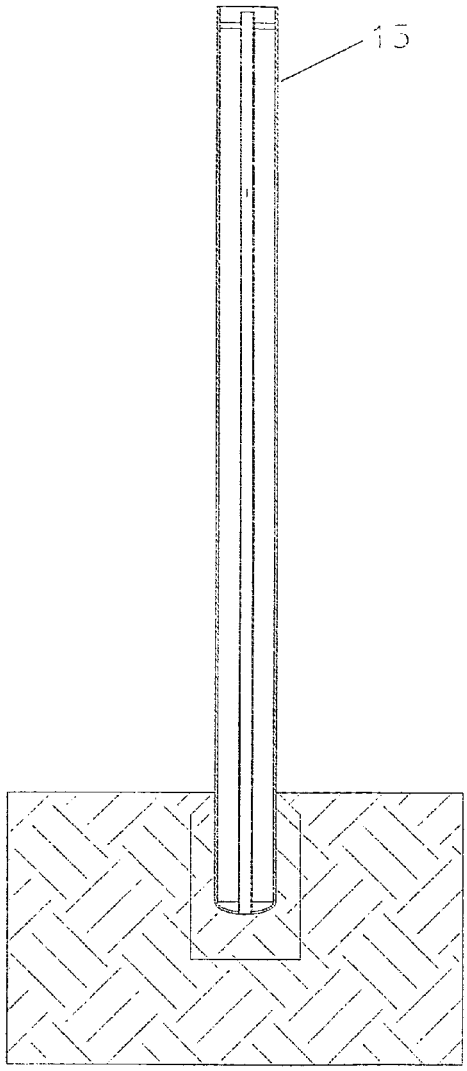
FIG. 19 is a half section thru the corner of a platform section showing that the platform has been removed from the top of the second post.

Referring now to FIG. 19, a half section of support post 13 is shown with the nut 20, threaded shoulder 62 and platform section 2 removed.

Figure 20:
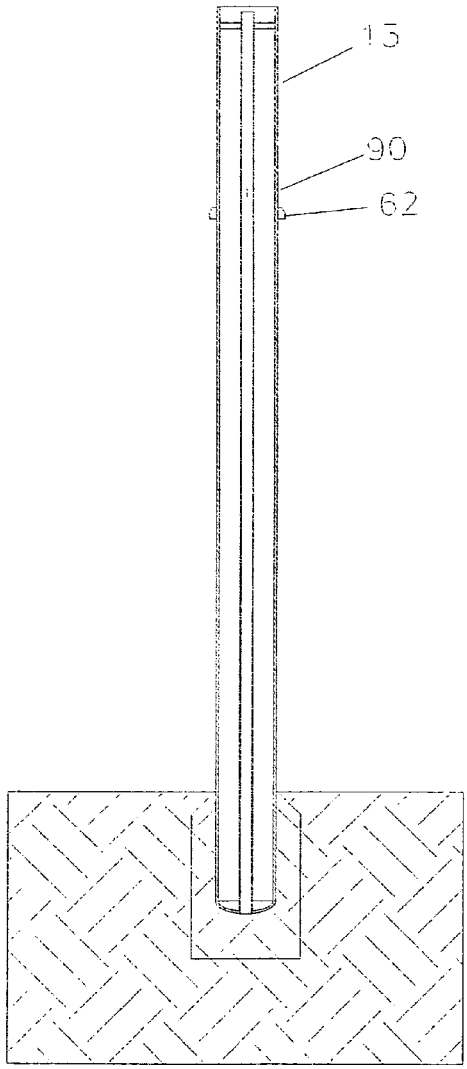
FIG. 20 is a half section thru the corner of a platform section showing that the lower nut has been reinstalled in the upside down position.

Referring now to FIG. 20, a half section of support post 13 is shown with the threaded shoulder 62 reinstalled upside down onto external thread 90.

Figure 21:
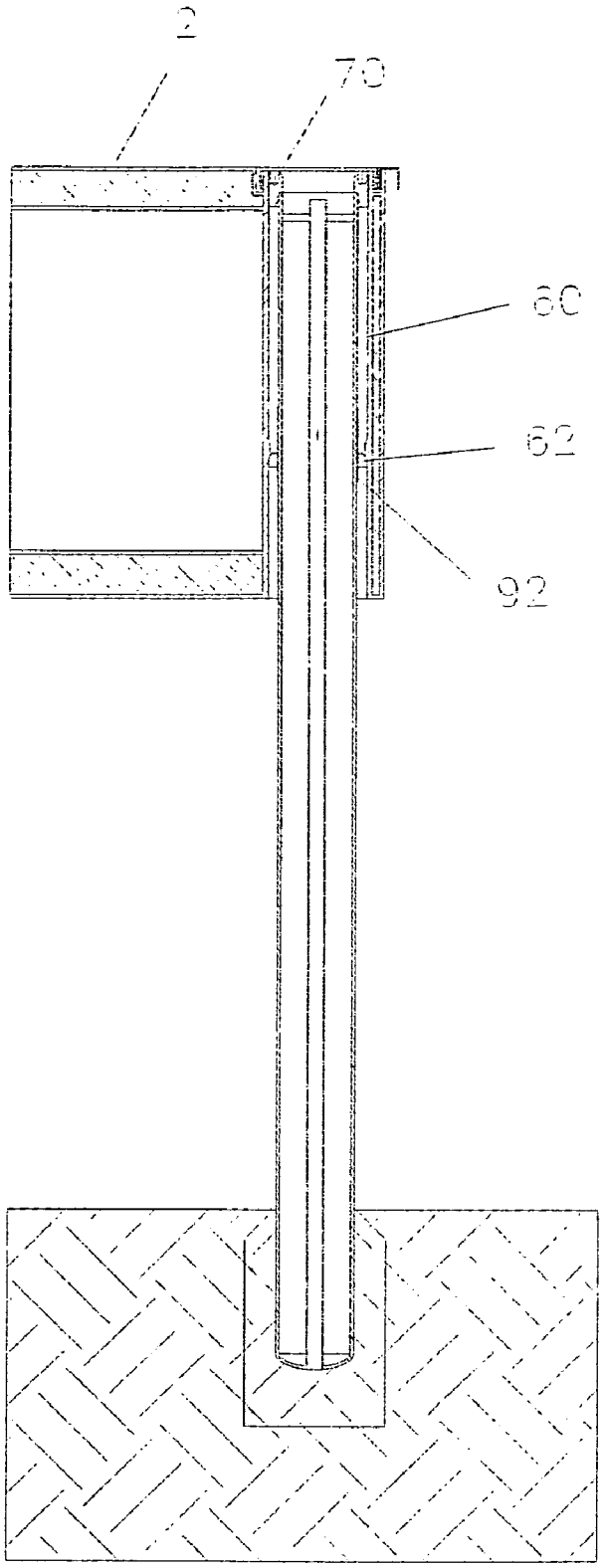
FIG. 21 is a half section thru the corner of a platform section showing that the platform section is relanded on the top of the second posts.

Referring now to FIG. 21, a half section of a portion of platform section 2 is shown re-landed on threaded shoulder 62 by downward facing shoulder 92 within sleeve 60. Nut 70 is reinstalled and the platform is ready for operations.

Figure 22:
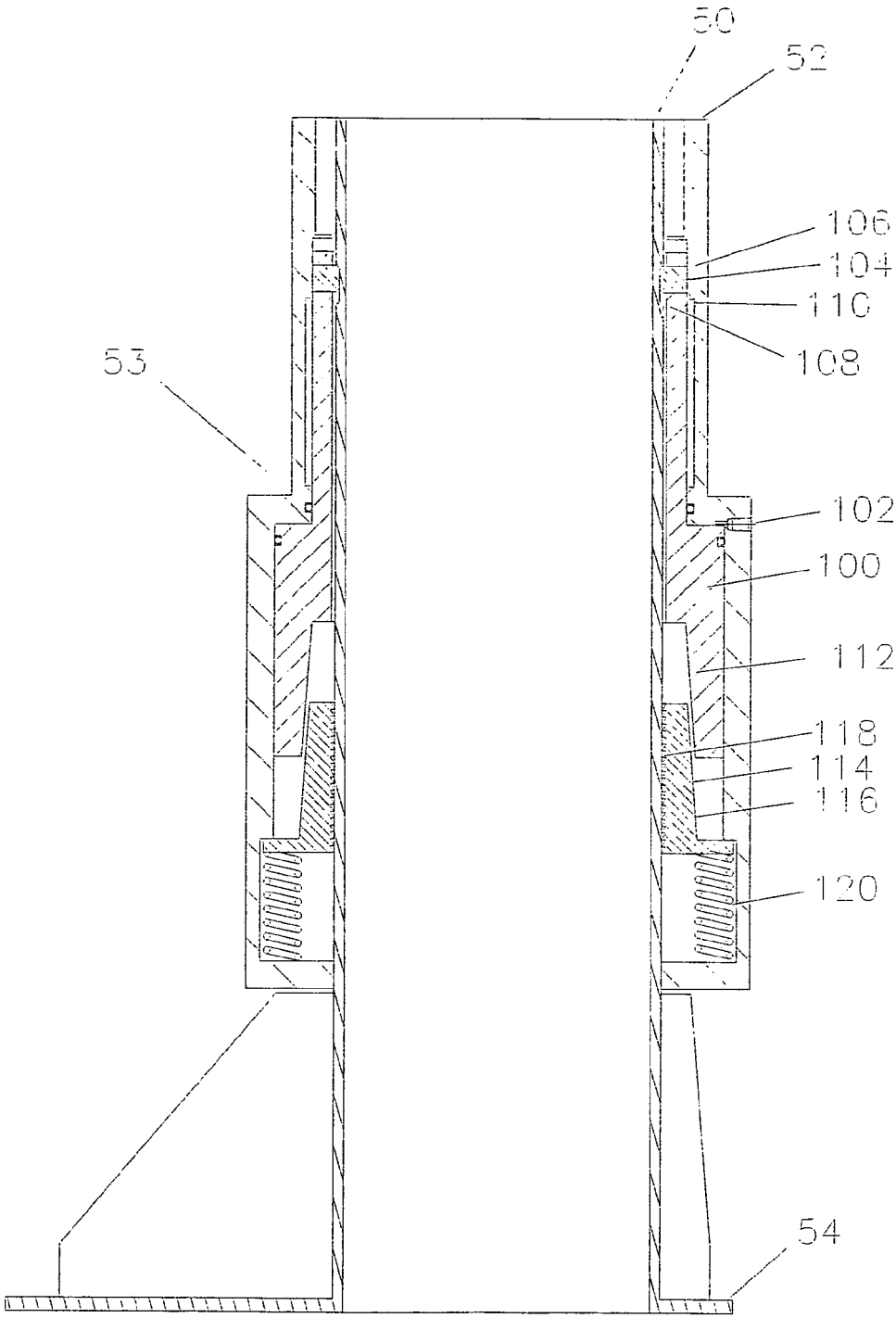
FIG. 22 is a half section thru the connector portion of a landing post.

Referring now to FIG. 22, a detailed half section view of the connector 53 is shown with the inner sleeve 50, the outer sleeve 52, the foot 54, a piston 100, a fluid port for the piston 102, and a set of dogs 104 in windows 106 of piston 100 engaging a groove 108 in the inner sleeve 50. Piston 100 is held up by holding a vacuum on the inlet port 102 during initial operations. In this position, dog 104 is held in the current position and thereby inner sleeve 50 and foot 52 are held in the current position because of the dog 104 engagement with groove 108. When pressure is introduced into port 102, the piston 100 an dog 104 move downwardly until the dog can move out into the recess 110, moving out of groove 108, allowing the inner sleeve 50 with foot 54 to fall downwardly until it stops when the foot 54 lands on the tundra surface. Further downward movement of the piston 100 will cause the tapered surface 112 of piston 100 to hit the tapered surface 114 of slip segments 116 and load them onto the outer surface 118 of inner sleeve 50. The hydraulic flow causing the downward movement will be metered so that the foot 54 will have a chance to be landed before the slip engagement occurs. Continued pressure input into port 102 will allow the pressure to build up above the piston and allow the piston and inner sleeve combination to support the full weight of the platform section. At this time if a valve is closed or a check valve is allowed to close, the fluid pressure can be trapped in the piston and cause the position of the platform section to be stabilized until the support posts can be installed. Spring 120 facilitate the slip segments 116 being held in the proper position until the slip segments 116 are ready to be utilized.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A method of supporting a platform section for above the surface of the earth comprising:

landing said platform section a distance above said surface of said earth on one or more first supports depending from said platform, drilling one or more holes in the earth, inserting one or more second supports into said holes, placing a filler material between said one or more holes and said one or more second supports, and allowing said filler materials to solidify.

2. The method of claim 1, further comprising removing said one or more first supports from said surface of said earth.

3. The method of claim 1, further comprising said filler material comprising water and sand.

4. The method of claim 1, further comprising said solidifying being freezing.

5. The method of claim 1, further comprising said one or more second supports being within said one or more first supports.

6. The method of claim 1, further comprising said surface of said earth being the surface of arctic tundra.

7. A method of supporting a platform section above the surface of the earth for the exploration of oil, gas, or hydrate reserves comprising:

lowering a platform to a distance above the surface of the earth, engaging a first set of supports depending from said platform with the surface of the earth, drilling holes in the earth, inserting a second set of supports in the drilled holes, adding a slurry in to the drilled holes, and allowing the slurry to freeze to support the platform.

8. The method of claim 7, further comprising, lifting said first set of supports off the surface of the earth after the second set of supports are installed.

9. The method of claim 7, wherein said earth is arctic tundra.

10. The method of claim 7, wherein said distance is predetermined.

11. The method of claim 7, wherein said distance is measured by sonar.

12. The method of claim 7, wherein said first set of supports are engaged by dropping them relative to said platform.

13. The method of claim 7, wherein said holes for said second set of supports are drilled from the deck of said platform section.

14. The method of claim 7, wherein one or more of said second set of supports are installed concentrically with said first set of supports.

15. The method of claim 7, wherein said second set of supports are supported by said platform section during he freezing.

16. The method of claim 7, wherein said second set of post are supported on shoulders of said platform section during freezing, and said platform section can be removed over the top of said second set of supports after freezing.

17. The method of claim 7 further comprising adding said slurry into said drilled holes thru the center of said second set of supports.

* * * * *